US011526187B2

(12) United States Patent
Gheorghiu

(10) Patent No.: US 11,526,187 B2
(45) Date of Patent: Dec. 13, 2022

(54) METHOD AND SYSTEM FOR BOOSTING OUTPUT CURRENT

(71) Applicant: SKYWORKS SOLUTIONS, INC., Irvine, CA (US)

(72) Inventor: Gabriel Bogdan Gheorghiu, Ottawa (CA)

(73) Assignee: SKYWORKS SOLUTIONS, INC., Irvine, CA (US)

( * ) Notice: Subject to any disclaimer, the term of this patent is extended or adjusted under 35 U.S.C. 154(b) by 42 days.

(21) Appl. No.: 17/136,345

(22) Filed: Dec. 29, 2020

(65) Prior Publication Data

US 2021/0208616 A1 Jul. 8, 2021

Related U.S. Application Data

(60) Provisional application No. 62/959,007, filed on Jan. 9, 2020, provisional application No. 62/956,708, filed on Jan. 3, 2020.

(51) Int. Cl.

| | |
|---|---|
| ***G05F 1/575*** | (2006.01) |
| ***G05F 1/46*** | (2006.01) |
| ***G05F 3/26*** | (2006.01) |
| ***G05F 1/445*** | (2006.01) |

(52) U.S. Cl.

CPC ..... *G05F 1/575* (2013.01); *G05F 1/445* (2013.01); *G05F 1/461* (2013.01); *G05F 3/262* (2013.01)

(58) Field of Classification Search

CPC ..... G05F 1/565; G05F 1/571; G05F 1/573; G05F 1/461; G05F 3/262

See application file for complete search history.

(56) References Cited

U.S. PATENT DOCUMENTS

| | | | | |
|---|---|---|---|---|
| 7,170,269 | B1 * | 1/2007 | Doyle | G05F 1/575 323/280 |
| 7,218,168 | B1 * | 5/2007 | Rahman | G05F 1/56 327/540 |
| 7,342,387 | B1 * | 3/2008 | Li | G05F 1/575 323/282 |
| 11,029,716 | B1 * | 6/2021 | Chan | G05F 1/575 |
| 2017/0052553 | A1 * | 2/2017 | Gebeyehu | H03F 3/245 |
| 2017/0185094 | A1 * | 6/2017 | Atkinson | H02J 7/00 |

(Continued)

FOREIGN PATENT DOCUMENTS

| | | | | |
|---|---|---|---|---|
| DE | 112018006342 T5 | * 8/2020 | | G06F 1/266 |
| KR | 20210157606 A | * 12/2021 | | |
| WO | WO-2013119587 A1 | * 8/2013 | | H03F 1/02 |

*Primary Examiner* — Sisay G Tiku

(74) *Attorney, Agent, or Firm* — Lando & Anastasi, LLP

(57) ABSTRACT

Aspects of the disclosure include a device comprising an energy storage device configured to provide first power having a first voltage level, a voltage regulator coupled to the energy storage device and configured to receive the first power and regulate the first power to generate regulated power having a set output regulated voltage level, and bias circuitry coupled to the voltage regulator and including an output branch to output a bias current, and a feedback branch to control the bias current, the feedback branch including a bias-boosting component configured to be in an active mode responsive to the first voltage level being below the set output regulated voltage level and to be in an inactive mode responsive to the first voltage level being at or above the set output regulated voltage level.

21 Claims, 5 Drawing Sheets

(56) References Cited

U.S. PATENT DOCUMENTS

| | | | | |
|---|---|---|---|---|
| 2017/0185096 | A1* | 6/2017 | Rueger | G05F 3/262 |
| 2017/0364110 | A1* | 12/2017 | Golara | G05F 1/573 |
| 2018/0120881 | A1* | 5/2018 | Gebeyehu | H03F 3/19 |
| 2019/0146531 | A1* | 5/2019 | Yung | G05F 1/563 363/21.01 |
| 2019/0243403 | A1* | 8/2019 | Gebeyehu | H03F 1/0227 |
| 2019/0302819 | A1* | 10/2019 | Hu | G05F 1/575 |
| 2021/0397207 | A1* | 12/2021 | Joo | G05F 1/575 |

* cited by examiner

METHOD AND SYSTEM FOR BOOSTING OUTPUT CURRENT

CROSS-REFERENCE TO RELATED APPLICATIONS

This application claims priority under 35 U.S.C. § 119(e) to U.S. Provisional Patent Application No. 62/956,708, titled METHOD AND SYSTEM FOR BOOSTING OUTPUT CURRENT, filed Jan. 3, 2020, and to U.S. Provisional Patent Application No. 62/959,007, titled METHOD AND SYSTEM FOR BOOSTING OUTPUT CURRENT, filed Jan. 9, 2020, the contents of which are incorporated herein in their entireties for all purposes.

BACKGROUND

1. Field of the Disclosure

At least one example in accordance with the present disclosure relates generally to controlling output current from a current source.

2. Discussion of Related Art

Electronic devices include one or more components powered by a source of electrical energy, such as a battery. Various electronic devices may further include power conditioning circuitry configured to condition battery power prior to providing the power to the one or more powered components. For example, various electronic devices may include voltage regulators, power amplifiers, bias circuitry, and so forth, configured to condition power received from an energy storage device prior to providing power to one or more powered components.

SUMMARY

According to at least one aspect of the present disclosure, a device is provided comprising an energy storage device configured to provide first power having a first voltage level, a voltage regulator coupled to the energy storage device and configured to receive the first power and regulate the first power to generate regulated power having a set output regulated voltage level, and bias circuitry coupled to the voltage regulator and including an output branch to output a bias current, and a feedback branch to control the bias current, the feedback branch including a bias-boosting component configured to be in an active mode responsive to the first voltage level being below the set output regulated voltage level and to be in an inactive mode responsive to the first voltage level being at or above the set output regulated voltage level.

In various examples, the bias-boosting component includes a first voltage-controlled switch. In some examples, the first voltage-controlled switch is configured to be closed and conducting during the active mode, and is configured to be open and non-conducting in the inactive mode. In at least one examples, the first voltage-controlled switch is a metal-oxide semiconductor field-effect transistor (MOSFET), and wherein the MOSFET is in a triode region during the active mode and is in a subthreshold region in the inactive mode. In various examples, the bias circuitry includes a current mirror having the output branch and the feedback branch.

In some examples, the bias circuitry includes a supply voltage input coupled to the output branch and the feedback branch, and wherein the bias circuitry is configured to receive a supply voltage from the voltage regulator via the supply voltage input. In at least one example, the feedback branch includes an error amplifier having a first input to receive a reference voltage, a second input to receive a feedback voltage, and an output to provide an output control signal. In various examples, the feedback branch includes a resistor coupled to the second input of the error amplifier and coupled in parallel with the MOSFET.

In at least one example, the feedback branch includes a second voltage-controlled switch and the output branch includes a third voltage-controlled switch, and wherein the output of the error amplifier is configured to be coupled to, and provide the output control signal to, a control connection of the second voltage-controlled switch and a control connection of the third voltage-controlled switch. In some examples, the device further comprises a power amplifier. In various examples, the power amplifier is configured to receive the regulated power from the voltage regulator, receive the bias current from the bias circuitry, amplify one or more signals based on the regulated power and the bias current.

In various examples, the feedback branch includes an error amplifier having a first input to receive a reference voltage, a second input to receive a feedback voltage, and an output to provide an output control signal. In some examples, the feedback branch includes a resistor coupled to the second input of the error amplifier and coupled in parallel with the first voltage-controlled switch.

According to an aspect of the disclosure, a method of operating a device is provided, the device including an energy storage device, a voltage regulator coupled to the energy storage device and being configured to provide regulated power having a set output regulated voltage level, and bias circuitry coupled to the voltage regulator and including a bias-boosting component, the method comprising providing first power having a first voltage level from the energy storage device to the voltage regulator, regulating, by the voltage regulator, the first power to generate first regulated power, providing the first regulated power from the voltage regulator to the bias circuitry, activating the bias-boosting component responsive to the first voltage level being less than the set output regulated voltage level, and outputting, by the bias circuitry, a boosted bias current responsive to activating the bias-boosting component.

In various examples, the method further comprises providing second power having a second voltage level from the energy storage device to the voltage regulator, regulating, by the voltage regulator, the second power to generate second regulated power, providing the second regulated power from the voltage regulator to the bias circuitry, deactivating the bias-boosting component responsive to the second voltage level being at or above the set output regulated voltage level, and outputting, by the bias circuitry, a non-boosted bias current responsive to deactivating the bias-boosting component.

In at least one example, the bias-boosting component includes a voltage-controlled switch, and wherein activating the bias-boosting component includes controlling the voltage-controlled switch to be in a closed and conducting state and deactivating the bias-boosting component includes controlling the voltage-controlled switch to be in an open and non-conducting state. In various examples, the bias circuitry includes an error amplifier having a first input to receive a reference voltage, a second input to receive a feedback voltage, and an output to provide an output signal, a resistor coupled to the second input coupled in parallel with the voltage-controlled switch, wherein activating the bias-boosting component includes shunting current away from the resistor.

In some examples, the bias circuitry includes at least one second voltage-controlled switch, the method further comprising providing the output signal to a control connection of the at least one second voltage-controlled switch to control one of the boosted bias current and the non-boosted bias current. In at least one example, the device includes a power amplifier and one or more powered components, the method further comprising receiving, by the power amplifier, the first regulated power from the voltage regulator, receiving, by the power amplifier, the boosted bias current from the bias circuitry, amplifying, by the power amplifier, one or more signals based on the first regulated power and the boosted bias current.

According to an aspect of the disclosure, a biasing system is provided comprising an input to receive a supply voltage having a first voltage level, an output branch having an output to provide a bias current to a load, and a feedback branch including a bias-boosting component configured to be in an active mode responsive to the first voltage level being below a set voltage threshold level and to be in an inactive mode responsive to the first voltage level being above the set voltage threshold level.

BRIEF DESCRIPTION OF THE DRAWINGS

Various aspects of at least one embodiment are discussed below with reference to the accompanying figures, which are not intended to be drawn to scale. The figures are included to provide an illustration and a further understanding of the various aspects and embodiments, and are incorporated in and constitute a part of this specification, but are not intended as a definition of the limits of any particular embodiment. The drawings, together with the remainder of the specification, serve to explain principles and operations of the described and claimed aspects and embodiments. In the figures, each identical or nearly identical component that is illustrated in various figures is represented by a like numeral. For purposes of clarity, not every component may be labeled in every figure. In the figures:

DETAILED DESCRIPTION

Figure 1:
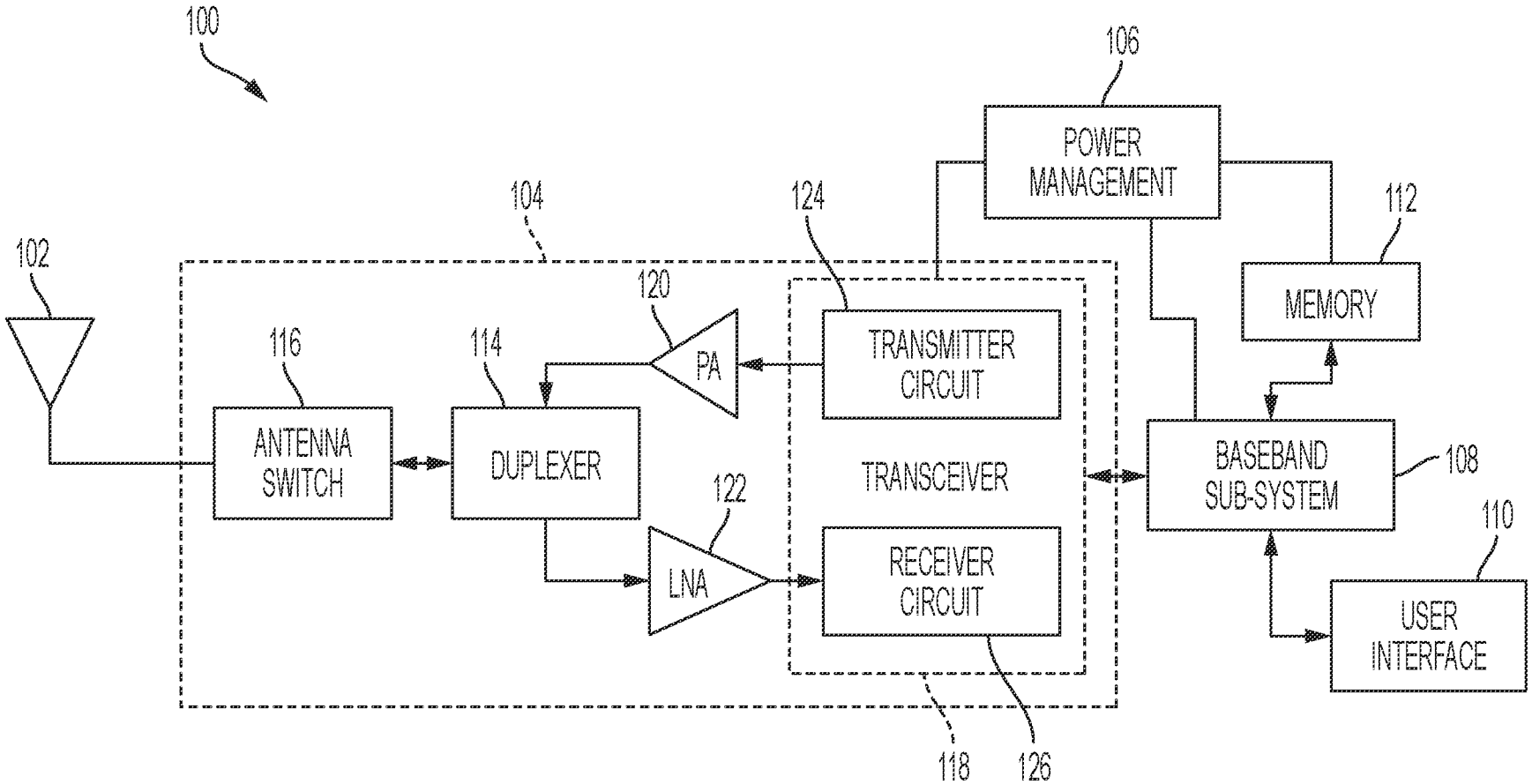
FIG. 1 illustrates a block diagram of a device according to an example.

Examples of the methods and systems discussed herein are not limited in application to the details of construction and the arrangement of components set forth in the following description or illustrated in the accompanying drawings. The methods and systems are capable of implementation in other embodiments and of being practiced or of being carried out in various ways. Examples of specific implementations are provided herein for illustrative purposes only and are not intended to be limiting. In particular, acts, components, elements and features discussed in connection with any one or more examples are not intended to be excluded from a similar role in any other examples.

Also, the phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are no intended to limit the presently disclosed systems or methods, their components, acts, or elements. The use herein of "including," "comprising," "having," "containing," "involving," and variations thereof is meant to encompass the items listed thereafter and equivalents thereof as well as additional items.

References to "or" may be construed as inclusive so that any terms described using "or" may indicate any of a single, more than one, and all of the described terms. In addition, in the event of inconsistent usages of terms between this document and documents incorporated herein by reference, the term usage in the incorporated features is supplementary to that of this document; for irreconcilable differences, the term usage in this document controls.

Communication devices include one or more powered components, and a source of electrical energy to power the one or more powered components. For example, mobile communication devices, such as tablet computers, cellular phones, and so forth, may include one or more powered components and at least one battery configured to provide power to the one or more powered components.

One or more powered components within communication devices may include one or more amplifiers, such as power amplifiers and/or low-noise amplifiers, configured to amplify data signals (for example, radio-frequency [RF] signals) based on a bias current provided by bias circuitry. The bias circuitry, in turn, may be powered by the at least one battery in order to provide the bias current to the one or more amplifiers.

However, a battery voltage provided by the battery may decrease over time. For example, the battery voltage may decrease as the battery is depleted over a discharge cycle. Performance of the electronic device may be adversely impacted if the battery voltage provided to the voltage regulator decreases below a set output regulated voltage level of the voltage regulator (that is, a voltage level at which the voltage regulator is to provide output power). More particularly, DC bias conditions (for example, a bias current level) may degrade if the battery voltage decreases below the regulated voltage level, thereby adversely impacting device performance.

Examples provided herein provide bias circuitry configured to increase a bias current level responsive to a battery voltage decreasing below a set regulated voltage level. In one example, a transistor is implemented in bias circuitry configured to provide a bias current to one or more power amplifiers. More particularly, the transistor may be implemented as a shunt in a feedback resistive network of an error amplifier in the bias circuitry. The transistor consumes minimal current when the battery voltage is above the regulated voltage level and therefore has minimal effect on the bias current. When the battery voltage decreases below the regulated voltage level, the transistor shunts current from a resistive element in the feedback resistive network, thereby decreasing a feedback voltage provided to the error amplifier. Decreasing the feedback voltage increases an error signal and produces an increase in an output bias current. Accordingly, implementation of the transistor enables the bias current to be boosted where the battery voltage decreases below the regulated voltage level. Various examples provided herein thus address a decrease in battery voltage by providing a compensating increase in bias current provided to one or more power amplifiers.

FIG. 1 is a block diagram of one example of a wireless device 100 according to an example. The wireless device 100 can be a cellular phone, smart phone, tablet, modem, communication network or any other portable or non-portable device configured for voice or data communication. The wireless device 100 includes an antenna 102, a front-end module 104, a power management system 106, a baseband sub-system 108, a user interface 110, and a memory 112. The front-end module 104 includes a duplexer 114, an antenna switch 116, a transceiver 118, a power amplifier (PA) module 120, and a low-noise amplifier (LNA) module 122. The transceiver 118 includes a transmitter circuit 124 and a receiver circuit 126.

The wireless device 100 can receive and transmit signals from the antenna 102. The antenna switch 116 can be configured to switch between different frequency bands or modes, such as transmit and receive modes, for example. In the example illustrated in FIG. 1, the antenna switch 116 is positioned between the duplexer 114 and the antenna 102. However, in other examples the duplexer 114 can be positioned between the antenna switch 116 and the antenna 102. In other examples the antenna switch 116 and the duplexer 114 can be integrated into a single component.

The transceiver 118, which includes the transmitter circuit 124 and the receiver circuit 126, is configured to generate signals for transmission or to process received signals. Signals generated for transmission by the transmitter circuit 124 are received by the power amplifier module 120, which amplifies the generated signals received from the transceiver 118. The power amplifier module 120 can include one or more power amplifiers. The power amplifier module 120 can be used to amplify a wide variety of RF or other frequency-band transmission signals. For example, the power amplifier module 120 can receive an enable signal that can be used to pulse the output of the power amplifier to aid in transmitting a wireless local area network (WLAN) signal or any other suitable pulsed signal. The power amplifier module 120 can be configured to amplify any of a variety of types of signal, including, for example, a Global System for Mobile (GSM) signal, a code division multiple access (CDMA) signal, a W-CDMA signal, a Long-Term Evolution (LTE) signal, or an EDGE signal. In certain embodiments, the power amplifier module 120 and associated components including switches and the like can be fabricated on gallium arsenide (GaAs) substrates using, for example, high-electron mobility transistors (pHEMT) or insulated-gate bipolar transistors (BiFET), or on a silicon substrate using complementary metal-oxide semiconductor (CMOS) field-effect transistors. As discussed above, the power amplifier module 120 may be configured to amplify signals generated by the transceiver 118 based in part on one or more bias signals provided by bias circuitry (not illustrated).

The low-noise amplifier module 122 amplifies signals received from the antenna 102 and provides the amplified signals to the receiver circuit 126 of the transceiver 118. Similar to the power amplifier module 120, the low-noise amplifier module 122 may be configured to amplify signals provided to the transceiver 118 based in part on one or more bias signals provided by bias circuitry (not illustrated).

The power management sub-system 106 is connected to the transceiver 118 and manages the power for the operation of the wireless device 100. In some examples, the power management sub-system 106 is coupled to the amplifiers 120, 122, as discussed in greater detail below. The power management system 106 can also control the operation of the baseband sub-system 108 and various other components of the wireless device 100. The power management system 106 can include, or can be connected to, a battery (not illustrated) that supplies power for the various components of the wireless device 100. The power management system 106 can further include one or more processors or controllers that can control the transmission of signals, for example. In one embodiment, the baseband sub-system 108 is connected to a user interface 110 to facilitate various input and output of voice and/or data provided to and received from the user. The baseband sub-system 108 can also be connected to the memory 112, which is configured to store data and/or instructions to facilitate the operation of the wireless device, and/or to provide storage of information for the user.

Figure 2:
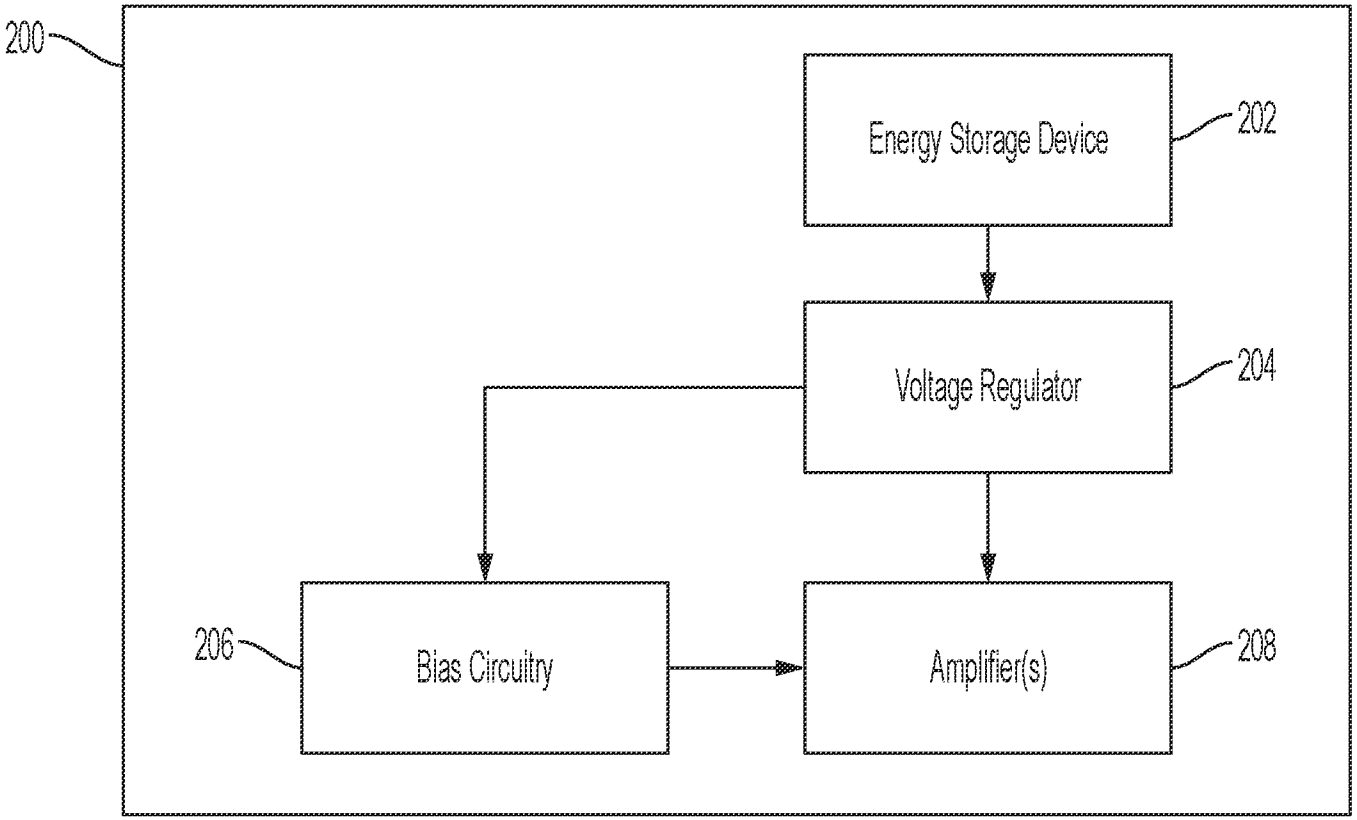
FIG. 2 illustrates a block diagram of a power management system according to an example.

FIG. 2 illustrates a block diagram of a power management system 200 according to an example. The power management system 200 may be implemented in a device such as a telecommunications device (for example, a mobile phone), or any other type of device powered by electrical energy. For example, the power management system 200 may be implemented in the device 100. In at least one example, the power management system 200 is an example of, or may include components of, the power management system 106.

The device 200 includes an energy storage device 202, a voltage regulator 204, bias circuitry 206, and an amplifier 208. In various examples, each of the components 202, 204, and 208 may include multiple components. For example, the amplifier 208 may include multiple amplifiers of the same or different types. Furthermore, in some examples, certain components illustrated in FIG. 2 may be external to the power management system 200. For example, the power management system 200 may be an example of the power management system 106, and the amplifier 208 may be external to the power management system 200 and include one or both of the amplifiers 120, 122.

The energy storage device 202 is coupled to, and is configured to provide power to, the voltage regulator 204. The voltage regulator 204 is coupled to the energy storage device 202, the bias circuitry 206, and the amplifier 208, and is configured to provide power derived from the energy storage device 202 to the bias circuitry 206 and the amplifier 208. The amplifier 208 is coupled to the voltage regulator 204 and the bias circuitry 206, and is configured to amplify one or more signals based on regulated power received from the voltage regulator 204 and a bias signal received form the bias circuitry 206. The bias circuitry 206 is coupled to the voltage regulator 204 and the amplifier 208, and is configured to provide one or more bias signals to the amplifier 208 based on regulated power received from the voltage regulator 204.

The energy storage device 202 is configured to store electrical energy and provide electrical energy to the voltage regulator 204. For example, the energy storage device 202 may include at least one battery, such as a lithium-ion battery. The energy storage device 202 may be rechargeable by a charger configured to charge the energy storage device 202 via a wired or wireless charging path (not illustrated). As the energy storage device 202 discharges stored electrical energy to the voltage regulator 204, a voltage level of the energy storage device 202 may decrease. Accordingly, a voltage level of power provided by the energy storage device 202 to the voltage regulator 204 may decrease over a discharge cycle of the energy storage device 202.

The voltage regulator 204 is configured to receive power from the energy storage device 202, regulate the received power to a set regulated voltage level (that is, a desired output voltage level), and provide regulated power to the bias circuitry 206 and the amplifier 208. The voltage regulator 204 may include one of several existing topologies to regulate the received power and provide regulated power having a constant voltage level. In various examples, a voltage level of regulated power provided by the voltage regulator 204 may only be as high as a voltage level of power received from the energy storage device 202. Accordingly, if a voltage level of power received from the energy storage device 202 decreases below the set regulated voltage level, the voltage regulator 204 may be unable to provide regulated power at the set regulated voltage level in some examples.

The bias circuitry 206 is configured to determine a voltage level of regulated power provided by the voltage regulator 204, generate one or more bias signals based on the voltage level of the regulated power, and provide the one or more bias signals to the amplifier 208. As discussed in greater detail below, the bias circuitry 206 includes at least one component (for example, a transistor) configured to control the bias circuitry 206 to increase a level of a bias signal responsive to the voltage regulator 204 providing regulated power having a voltage level below the set regulated voltage level (for example, because the energy storage device 202 is unable to provide voltage having a desired voltage level to the voltage regulator 204). The increased level of the bias signal may at least partially compensate for the decreased regulated voltage level of regulated power provided to the amplifier 208.

The amplifier 208 is configured to receive regulated power from the voltage regulator 204, receive one or more bias signals from the bias circuitry 206, and amplify one or more signals (for example, one or more RF signals) based at least in part on the one or more bias signals received from the bias circuitry 206.

Figure 3:
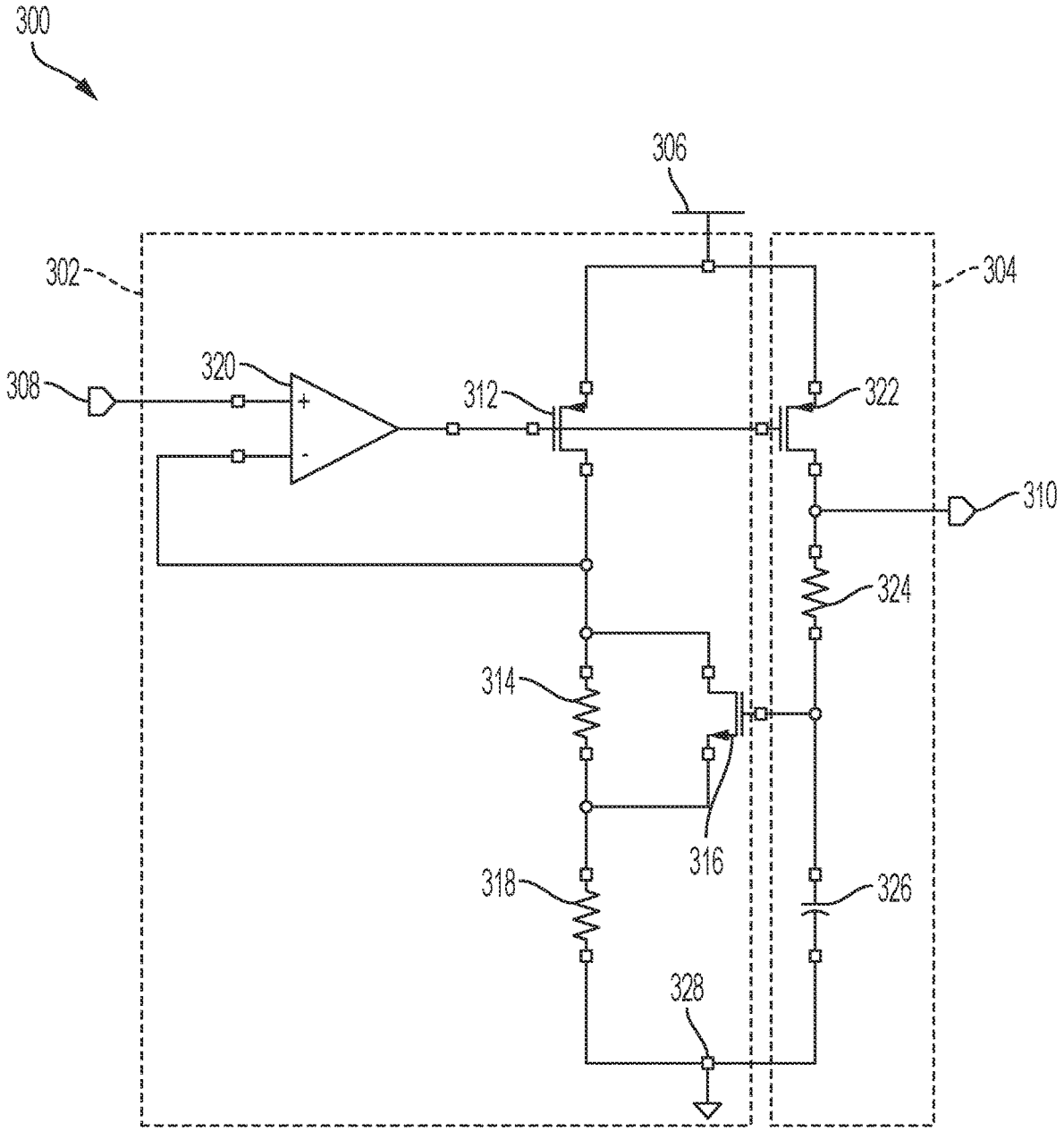
FIG. 3 illustrates a schematic diagram of bias circuitry according to an example.

For example, FIG. 3 illustrates a schematic diagram of bias circuitry 300 according to an example. The bias circuitry 300 may include an example of, or be in included in an example of, the bias circuitry 206. The bias circuitry 300 is generally configured in a current mirror topology, and includes a feedback branch 302, an output branch 304, a supply voltage input 306, a reference voltage input 308, and a bias signal output 310.

The feedback branch 302 includes a first switching device 312, a first resistive element 314, a second switching device 316, a second resistive element 318, and an error amplifier 320. The output branch 304 includes a third switching device 322, a third resistive element 324, and a capacitor 326. Each of the switching devices 312, 316, 322 may include a metal-oxide semiconductor field-effect transistor (MOSFET) having a drain, a source, and a gate. In other examples, other types and/or combinations of switches may be used.

The supply voltage input 306 is coupled to a first connection of the first switching device 312 and a first connection of the third switching device 322, and is configured to be coupled to a source of a supply voltage. For example, the source of the supply voltage may be the voltage regulator 204, and the supply voltage may be the regulated voltage provided by the voltage regulator 204. As discussed above, a voltage level of the regulated voltage may be based on a voltage level of the energy storage device 202.

The reference voltage input 308 is coupled to a noninverting connection of the error amplifier 320, and is configured to be coupled to a source of a reference voltage. For example, the reference voltage may be a desired amplified voltage level to be output by the amplifier 208.

The bias signal output 310 is coupled between the third switching device 322 and the third resistive element 324, and is configured to be coupled to one or more components to which to provide a bias current. For example, the bias signal output 310 may be coupled to the amplifier 208, and a bias current may be provided to the amplifier 208 via the bias signal output 310 to bias the amplifier 208.

The first switching device 312 includes the first connection coupled to the supply voltage input 306, a second connection coupled to an inverting connection of the error amplifier 320, a first connection of the first resistive element 314, and a first connection of the second switching device 316, and a control connection coupled to an output connection of the error amplifier 320. The first resistive element 314 includes the first connection coupled to the second connection of the first switching device 312, the inverting connection of the error amplifier 320, and the first connection of the second switching device 316, and a second connection coupled to a second connection of the second switching device 316 and a first connection of the second resistive device 318.

The second switching device 316 includes the first connection coupled to the second connection of the first switching device 312, the inverting connection of the error amplifier 320, and the first connection of the first resistive element 314, the second connection coupled to the second connection of the first resistive element 314 and the first connection of the second resistive element 318, and a control connection coupled between the third resistive element 324 and the capacitor 326. The second resistive element 318 includes the first connection coupled to the second connection of the first resistive element 314 and the second connection of the second switching device 316, and a second connection coupled to a reference node 328 (for example, a ground node). The error amplifier 320 includes the noninverting connection coupled to the reference voltage input 308, the inverting connection coupled to the second connection of the first switching device 312, the first connection of the first resistive element 314, and the first connection of the second switching device 316, and the output connection coupled to the control connection of the first switching device 312 and a control connection of the third switching device 322.

The third switching device 322 includes the first connection coupled to the supply voltage input 306, a second connection coupled to the bias signal output 310 and a first connection of the third resistive element 324, and a control connection coupled to the output connection of the error amplifier 320. The third resistive element 324 includes the first connection coupled to the second connection of the third switching device 322 and the bias signal output 310, and a second connection coupled to the control connection of the second switching device 316 and a first connection of the capacitor 326. The capacitor 326 includes the first connection coupled to the second connection of the third resistive element 324 and the control connection of the second switching device 316, and a second connection coupled to the reference node 328.

As discussed above, the bias circuitry 300 is generally configured in a topology similar to a current mirror topology. As appreciated by one of ordinary skill in the art, a current mirror is generally configured to provide an output current based on (for example, approximately identical to) a current in a controlled branch. Similarly, the bias circuitry 300 is configured to provide a bias current at the bias signal output 310 via the output branch 304 based at least in part on a controlled current in the feedback branch 302, which is controlled by output signals provided by the error amplifier 320.

Output signals provided by the error amplifier 320 are based on an error between the reference voltage received at the non-inverting input of the error amplifier 320, and the feedback voltage received at the inverting input of the error amplifier 320. The feedback voltage is based on a voltage dropped across the first resistive element 314. The voltage dropped across the first resistive element 314 is based at least in part on a voltage level of the supply voltage and a current conducted by the first resistive element 314. The current conducted by the first resistive element 314 is based at least in part on a current conducted by the second switching device 316, which shunts current away from the first resistive element 314. That is, shunting current away from the first resistive element 314 decreases a current conducted by the first resistive element 314, and consequently reduces a voltage dropped across the first resistive element 314.

The feedback voltage received at the inverting terminal of the error amplifier 320 may therefore be controlled by controlling a current conducted by the second switching device 316. In various examples, the feedback voltage may be reduced by shunting current away from the first resistive element 314, thereby increasing an error detected by the error amplifier 320. Increasing the error detected by the error amplifier 320 increases a bias current provided to the bias current output 310 by the output branch 304.

Accordingly, in various examples, a bias current provided by the bias circuitry 300 may be boosted by increasing a current conducted by the second switching device 316. As discussed in greater detail below with respect to FIG. 4, examples are provided in which the second switching device 316 is sized to conduct an increased current where the voltage level of the supply voltage is below a threshold level (for example, where the energy storage device 202 is providing power with a voltage level below a desired level). More particularly, the second switching device 316 may be sized to be in a first, open and non-conductive subthreshold region where the voltage level of the supply voltage is at or above a threshold voltage level, and to be in a second, closed and conductive triode region where the voltage level of the supply voltage is below the threshold voltage level. As used herein, the second switching device 316 may be considered to be "closed and conducting" in the triode region although the second switching device 316 is not yet fully saturated.

Figure 4:
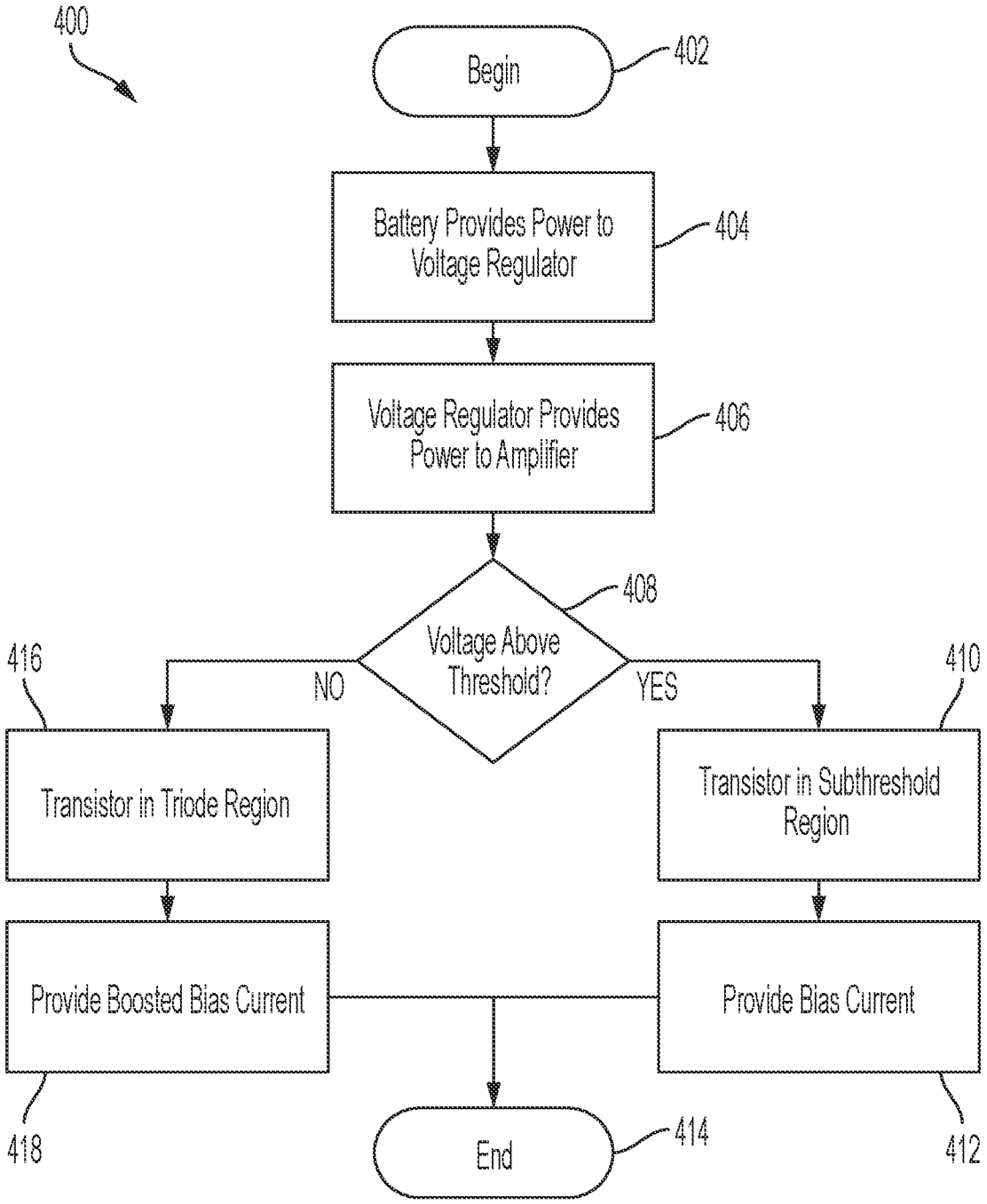
FIG. 4 illustrates a process of providing a bias current according to an example.

FIG. 4 illustrates a process 400 of providing a bias current according to an example. For example, the process 400 may be executed in connection with the device 100, the power management system 200, the bias circuitry 300, or a combination of the foregoing. For purposes of explanation only, examples are provided with reference to components of the device 100, the power management system 200, and the bias circuitry 300 as discussed above.

At act 402, the process 400 begins.

At act 404, a battery provides power having a battery voltage level to a voltage regulator. For example, the energy storage device 202 may include a battery configured to provide power having a battery voltage level to the voltage regulator 204. The battery voltage level of the power provided by the energy storage device 202 may decrease as the energy storage device 202 is discharged.

At act 406, the voltage regulator provides power having a regulated voltage level to an amplifier. For example, the voltage regulator 204 may provide power having a regulated voltage level to the amplifier 208. As discussed above, the voltage regulator 204 may be designed to provide regulated power having a set regulated voltage level to the amplifier 208. However, the voltage regulator 204 may be unable to provide regulated power having the set regulated voltage level if the battery voltage level is below the set regulated voltage level. Accordingly, the regulated voltage level of the regulated power provided by the voltage regulator 204 may be below the set regulated voltage level where the battery voltage level is below the set regulated voltage level.

At act 408, a determination is made as to whether the regulated voltage level is at or above the set regulated voltage level. As discussed above, the regulated voltage level may be below the set regulated voltage level where, for example, the battery voltage level of power received by the voltage regulator 204 from the energy storage device 202 is below the set regulated voltage level (for example, because the energy storage device 202 has been at least partially discharged). If the regulated voltage level is at or above the set regulated voltage level (408 YES), the process 400 continues to act 410.

At act 410, a feedback MOSFET is in a subthreshold region. For example, the second switching device 316 may be a MOSFET operating in the subthreshold region. As appreciated by one of ordinary skill in the art, a MOSFET may be in the subthreshold region where a gate-to-source voltage of the MOSFET is below a threshold voltage of the MOSFET. The MOSFET conducts minimal current in the subthreshold region. Accordingly, the MOSFET in the subthreshold region may be considered to be in an "inactive" mode, because minimal current is conducted by the MOSFET in the subthreshold region.

The second switching device 316 may be sized to be in the subthreshold region, and therefore conduct minimal current, where the regulated voltage level is at or above the set regulated voltage level (408 YES). That is, the second switching device 316 may be sized such that a gate-to-source voltage is below the threshold voltage of the second switching device 316 where the regulated voltage level is at or above the set regulated voltage level. In such examples, the second switching device 316 shunts minimal current away from the first resistive element 314 and therefore has a minimal or negligible effect on a feedback voltage received by the error amplifier 320.

At act 412, a bias current is provided to a bias current output. For example, a bias current may be provided to the bias current output 310 by the output branch 304 based on the feedback voltage provided to the error amplifier 320. Because the second switching device 316 is in a subthreshold region and shunts minimal current away from the first resistive element 314, a bias current provided at the bias current output 310 is substantially similar or identical to a bias current that would be provided if the second switching device 316 were removed from the bias circuitry 300 altogether.

At act 414, the process 400 ends.

Returning to act 408, if the regulated voltage level is below the set regulated voltage level (408 NO), the process 400 continues to act 416.

At act 416, the feedback MOSFET is in a triode region. For example, the second switching device 316 may be a MOSFET operating in the triode region. As appreciated by one of ordinary skill in the art, a MOSFET may be in the triode region where a gate-to-source voltage of the MOSFET is above a threshold voltage of the MOSFET, and where a difference between the gate-to-source voltage and the threshold voltage exceeds a drain-to-source voltage of the MOSFET. The MOSFET conducts appreciable current in the triode region, and behaves similarly to a resistor. Accordingly, the MOSFET in the triode region may be considered to be in an "active" mode, because appreciable current is conducted by the MOSFET in the triode region.

The second switching device 316 may be sized to be in the triode region, and therefore conduct appreciable current, where the regulated voltage level is below the set regulated voltage level (408 NO). That is, the second switching device 316 may be sized such that a gate-to-source voltage is greater than the threshold voltage of the second switching device 316 and a difference between the gate-to-source voltage and the threshold voltage exceeds a drain-to-source voltage where the regulated voltage level is below the set regulated voltage level. In such examples, the second switching device 316 shunts appreciable current away from the first resistive element 314, and the first resistive element 314 therefore conducts less current. Consequently, a voltage dropped across the first resistive element 314 decreases, and the feedback voltage provided to the inverting terminal of the error amplifier 320 decreases in turn.

At act 418, a boosted bias current is provided to a bias current output. For example, a bias current may be provided to the bias current output 310 by the output branch 304 based on the feedback voltage provided to the inverting terminal of the error amplifier 320. Because the second switching device 316 is in a triode region and shunts appreciable current away from the first resistive element 314, a feedback voltage received by the error amplifier 320 is reduced, thereby increasing an error amplified by the error amplifier 320. The error amplifier 320 responsively controls the switching devices 312, 322 to conduct additional current. Accordingly, a bias current provided at the bias current output 310 is larger than a bias current provided at act 412, above, where the regulated voltage level is at or above the set regulated voltage level. The bias current provided at the bias current output 310 may therefore be boosted where the regulated voltage level is below the set regulated voltage level compared to topologies in which the second switching device 316 is omitted.

At act 414, the process 400 ends.

Figure 5:
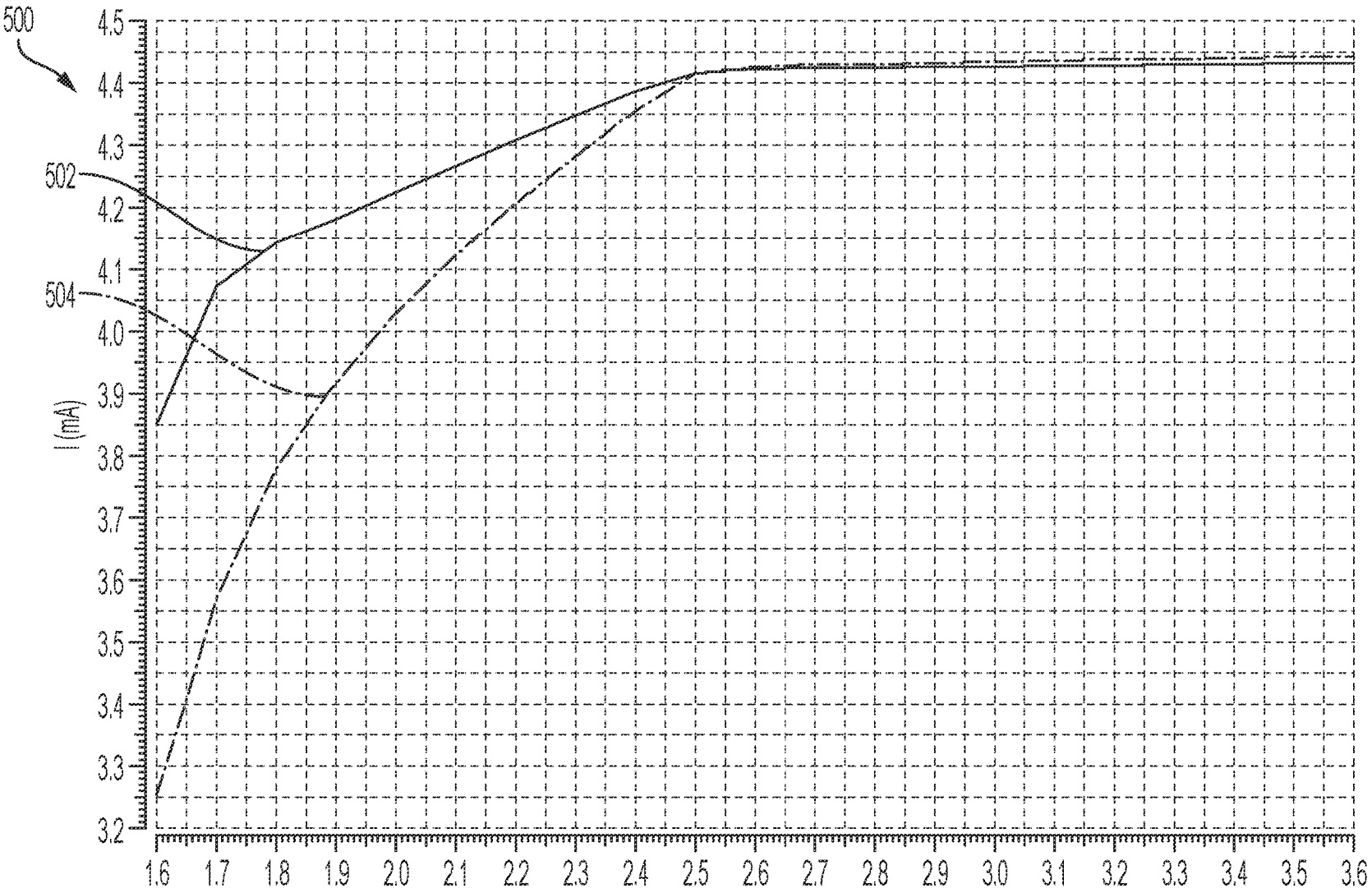
FIG. 5 illustrates a graph of bias current traces according to an example.

Accordingly, execution of the process 400 enables an increased bias current to be provided responsive to a battery voltage decreasing. For example, FIG. 5 illustrates a graph 500 of bias currents according to an example. An x-axis of the graph indicates a battery voltage level (for example, a battery voltage level of the energy storage device 202). A y-axis of the graph 500 indicates a bias current level (for example, a bias current level of a bias current provided at the bias current output 310).

The graph 500 includes a first trace 502 indicating a bias current as a function of battery voltage provided by circuitry including bias-current-boosting components (for example, the bias circuitry 300 including the second switching device 316). The graph 500 further includes a second trace 504 indicating a bias current as a function of battery voltage provided by circuitry not including bias current boosting components.

At battery-voltage values above a threshold value of approximately 2.5 V, the first trace 502 and the second trace 504 are substantially similar. The threshold value may be a voltage threshold below which the bias current boosting components are active (for example, at which the second switching device 316 is in the triode region) and above which the bias current boosting components are inactive (for example, at which the second switching device 316 is in the subthreshold region). Thus, the traces 502, 504 are substantially similar above the threshold voltage value, where the bias-current-boosting components are inactive.

At battery-voltage values below the threshold value, a bias-current value respectively indicated by each of the first trace 502 and the second trace 504 decreases as the battery voltage decreases. However, the second trace 504 decreases more rapidly than the first trace 502, such that the first trace 502 increasingly diverges from the second trace 504 as the battery voltage value decreases.

For example, where a threshold value is approximately 2.5 V as indicated above, the first trace 502 and the second trace 504 indicate that a bias current of approximately 4.425 mA is provided for battery-voltage values above 2.5 V. As a battery-voltage value decreases below 2.5 V, bias currents indicated by the traces 502, 504 decrease, albeit with the second trace 504 decreasing more rapidly. For example, at a battery-voltage value of approximately 1.6 V, the first trace 502 corresponds to a bias current of approximately 3.85 mA, whereas the second trace 504 corresponds to a bias current of approximately 3.25 mA. Thus, whereas a bias current indicated by the second trace 504 at 1.6 V is approximately 27% less than a bias current indicated by the second trace 504 above 2.5 V, a bias current indicated by the first trace 502 at 1.6 V is only approximately 13% less than a bias current indicated by the first trace 502 above 2.5 V.

Accordingly, examples have been provided in which biasing circuitry provides an increased bias current where a regulated-voltage level provided by a voltage regulator is below a set output-regulated-voltage level. For example, the increased bias current may be provided to one or more power amplifiers which may, in turn, provide increased power amplification to compensate for the decrease in the regulated-voltage level. In some examples, bias circuitry may be configured to provide a bias current to components other than power amplifiers.

Having thus described several aspects of at least one embodiment, it is to be appreciated various alterations, modifications, and improvements will readily occur to those skilled in the art. Such alterations, modifications, and improvements are intended to be part of, and within the spirit and scope of, this disclosure. Accordingly, the foregoing description and drawings are by way of example only.

What is claimed is:

1. A device comprising:

an energy storage device configured to provide first power having a first voltage level;

a voltage regulator coupled to the energy storage device and configured to receive the first power and regulate the first power to generate regulated power having a set output regulated voltage level; and bias circuitry coupled to the voltage regulator and including an output branch to output a bias current, and a feedback branch to control the bias current, the feedback branch including a bias-boosting component configured to be in an active mode responsive to the first voltage level being below the set output regulated voltage level and to be in an inactive mode responsive to the first voltage level being at or above the set output regulated voltage level.

2. The device of claim 1 wherein the bias-boosting component includes a first voltage-controlled switch.

3. The device of claim 2 wherein the first voltage-controlled switch is configured to be closed and conducting during the active mode, and is configured to be open and non-conducting in the inactive mode.

4. The device of claim 3 wherein the first voltage-controlled switch is a metal-oxide semiconductor field-effect transistor (MOSFET), and wherein the MOSFET is in a triode region during the active mode and is in a subthreshold region in the inactive mode.

5. The device of claim 4 wherein the bias circuitry includes a current mirror having the output branch and the feedback branch.

6. The device of claim 5 wherein the bias circuitry includes a supply voltage input coupled to the output branch and the feedback branch, and wherein the bias circuitry is configured to receive a supply voltage from the voltage regulator via the supply voltage input.

7. The device of claim 6 wherein the feedback branch includes an error amplifier having a first input to receive a reference voltage, a second input to receive a feedback voltage, and an output to provide an output control signal.

8. The device of claim 7 wherein the feedback branch includes a resistor coupled to the second input of the error amplifier and coupled in parallel with the MOSFET.

9. The device of claim 8 wherein the feedback branch includes a second voltage-controlled switch and the output branch includes a third voltage-controlled switch, and wherein the output of the error amplifier is configured to be coupled to, and provide the output control signal to, a control connection of the second voltage-controlled switch and a control connection of the third voltage-controlled switch.

10. The device of claim 9 further comprising a power amplifier.

11. The device of claim 10 wherein the power amplifier is configured to:

receive the regulated power from the voltage regulator;

receive the bias current from the bias circuitry; and amplify one or more signals based on the regulated power and the bias current.

12. The device of claim 2 wherein the feedback branch includes an error amplifier having a first input to receive a reference voltage, a second input to receive a feedback voltage, and an output to provide an output control signal.

13. The device of claim 12 wherein the feedback branch includes a resistor coupled to the second input of the error amplifier and coupled in parallel with the first voltage-controlled switch.

14. A method of operating a device including an energy storage device, a voltage regulator coupled to the energy storage device and being configured to provide regulated power having a set output regulated voltage level, and bias circuitry coupled to the voltage regulator and including a bias-boosting metal-oxide semiconductor field-effect transistor (MOSFET), the method comprising:

providing first power having a first voltage level from the energy storage device to the voltage regulator;

regulating, by the voltage regulator, the first power to generate first regulated power;

providing the first regulated power from the voltage regulator to the bias circuitry;

activating the bias-boosting MOSFET responsive to the first voltage level being less than the set output regulated voltage level, the activating including operating the bias-boosting MOSFET in a triode region; and outputting, by the bias circuitry, a boosted bias current responsive to activating the bias-boosting MOSFET.

15. The method of claim 14 further comprising:

providing second power having a second voltage level from the energy storage device to the voltage regulator;

regulating, by the voltage regulator, the second power to generate second regulated power;

providing the second regulated power from the voltage regulator to the bias circuitry;

deactivating the bias-boosting MOSFET responsive to the second voltage level being at or above the set output regulated voltage level; and outputting, by the bias circuitry, a non-boosted bias current responsive to deactivating the bias-boosting MOSFET.

16. The method of claim 15 wherein the bias-boosting MOSFET is a voltage-controlled switch, and wherein activating the bias-boosting MOSFET includes controlling the voltage-controlled switch to be in a closed and conducting state and deactivating the bias-boosting MOSFET includes controlling the voltage-controlled switch to be in an open and non-conducting state.

17. The method of claim 16 wherein the bias circuitry includes an error amplifier having a first input to receive a reference voltage, a second input to receive a feedback voltage, and an output to provide an output signal, a resistor coupled to the second input coupled in parallel with the voltage-controlled switch, wherein activating the bias-boosting MOSFET includes shunting current away from the resistor.

18. The method of claim 17 wherein the bias circuitry includes at least one second voltage-controlled switch, the method further comprising providing the output signal to a control connection of the at least one second voltage-controlled switch to control one of the boosted bias current and the non-boosted bias current.

19. The method of claim 14 wherein the device includes a power amplifier and one or more powered components, the method further comprising:

receiving, by the power amplifier, the first regulated power from the voltage regulator;

receiving, by the power amplifier, the boosted bias current from the bias circuitry; and amplifying, by the power amplifier, one or more signals based on the first regulated power and the boosted bias current.

20. A biasing system comprising:

an input to receive a supply voltage having a first voltage level;

an output branch having an output to provide a bias current to a load; and a feedback branch including a bias-boosting metal-oxide semiconductor field-effect transistor (MOSFET) configured to be in an active mode responsive to the first voltage level being below a set voltage threshold level and to be in an inactive mode responsive to the first voltage level being above the set voltage threshold level, the bias-boosting MOSFET being in a triode region in the active mode and in a subthreshold region in the inactive mode.

21. A method of operating a device including an energy storage device, a voltage regulator coupled to the energy storage device and being configured to provide regulated power having a set output regulated voltage level, and bias circuitry coupled to the voltage regulator and including a first voltage-controlled switch, a second voltage-controlled switch, and an error amplifier having a first input to receive a reference voltage, a second input to receive a feedback voltage, and an output to provide an output signal, the method comprising:

providing first power having a first voltage level from the energy storage device to the voltage regulator;

regulating, by the voltage regulator, the first power to generate first regulated power;

providing the first regulated power from the voltage regulator to the bias circuitry;

activating the first voltage-controlled switch responsive to the first voltage level being less than the set output regulated voltage level;

outputting, by the bias circuitry, a boosted bias current responsive to activating the bias-boosting component;

providing second power having a second voltage level from the energy storage device to the voltage regulator;

regulating, by the voltage regulator, the second power to generate second regulated power;

providing the second regulated power from the voltage regulator to the bias circuitry;

deactivating the first voltage-controlled switch responsive to the second voltage level being at or above the set output regulated voltage level;

outputting, by the bias circuitry, a non-boosted bias current responsive to deactivating the first voltage-controlled switch; and providing the output signal to a control connection of the at least one second voltage-controlled switch to control one of the boosted bias current or the non-boosted bias current.

* * * * *